US007809305B2

(12) United States Patent
Takuwa

(10) Patent No.: US 7,809,305 B2
(45) Date of Patent: Oct. 5, 2010

(54) CLEANING UNIT FOR ROLLER MEMBER SUPPORTING BELT AND IMAGE FORMING APPARATUS

(75) Inventor: Noriyuki Takuwa, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 636 days.

(21) Appl. No.: 11/748,554

(22) Filed: May 15, 2007

(65) Prior Publication Data

US 2007/0264057 A1 Nov. 15, 2007

(30) Foreign Application Priority Data

May 15, 2006 (JP) ..... 2006-135323

(51) Int. Cl.
*G03G 21/00* (2006.01)

(52) U.S. Cl. ..... 399/98; 399/302; 399/303; 399/349

(58) Field of Classification Search ..... 399/66, 399/101, 297, 299, 302, 303, 308, 313, 345, 399/349, 98
See application file for complete search history.

(56) References Cited

U.S. PATENT DOCUMENTS

| | | | | |
|---|---|---|---|---|
| 4,314,756 | A * | 2/1982 | Amitani et al. | 399/343 |
| 6,128,460 | A * | 10/2000 | Ito et al. | 399/303 |
| 7,509,074 | B2 * | 3/2009 | Yokoyama et al. | 399/162 |

FOREIGN PATENT DOCUMENTS

| | | |
|---|---|---|
| EP | 1628168 | 2/2006 |
| JP | 2001-192136 | 7/2001 |
| JP | 2003-091175 | 3/2003 |
| JP | 2006-071836 | 3/2006 |

OTHER PUBLICATIONS

Chinese Office Action dated Sep. 5, 2008 for Chinese application No. 200710097362.7 corresponding to U.S. Appl. No. 11/748,554, filed May 15, 2007.

* cited by examiner

*Primary Examiner*—David M Gray
*Assistant Examiner*—Barnabas T Fekete
(74) *Attorney, Agent, or Firm*—Turocy & Watson, LLP

(57) ABSTRACT

A felt that cleans the surface of a drive roller or secondary transfer supporting roller that stretches an intermediate transfer belt is supported by a Mylar at its one free end, the other end thereof being fixed to a bracket. The felt is swingably brought into contact with the drive roller or secondary transfer supporting roller by an elastic force of the Mylar.

5 Claims, 8 Drawing Sheets

CLEANING UNIT FOR ROLLER MEMBER SUPPORTING BELT AND IMAGE FORMING APPARATUS

CROSS-REFERENCE TO RELATED APPLICATION

This application is based upon and claims the benefit of priority from prior Japanese Patent Application No. 2006-135323 filed on May 15, 2006, the entire content of which are incorporated herein by reference.

BACKGROUND OF THE INVENTION

1. Field of the Invention

The present invention relates to a cleaning unit for a roller member supporting a belt that cleans a roller member supporting a belt member driven in an electrophotographic copier or printer that obtains an image by using the belt member and an image forming apparatus.

2. Description of the Related Art

Recently, there is known a tandem system image forming apparatus (copier, printer, or the like). In the tandem system image forming apparatus, a plurality of photoconductor drums are arranged in a line, toner images formed on the respective photoconductor drums are multiply-transferred onto one sheet of paper and, thereby, one color image is obtained. Some image forming apparatuses of this type include an intermediate belt unit, wherein the toner images formed on the respective photoconductors are primary-transferred onto an intermediate transfer belt and, after that, the primary-transferred color toner image on the intermediate transfer belt is secondary-transferred onto a sheet of paper at a time; and others include a conveyor belt unit, wherein the toner images formed on the respective photoconductors are directly transferred onto a sheet of paper conveyed by a conveyor belt.

The belt member such as the intermediate transfer belt unit or conveyor belt unit disposed opposite to a plurality of photoconductors is generally stretched over a plurality of rollers. In the image forming apparatus, toner is dispersed at the development or transfer time, or paper powder is caused at the transfer/peeling time. The dispersed toner or paper powder may be adhered to the surface of the belt member. Further, the dispersed toner or paper powder may be introduced inside the belt member and adhered to the back surface of the belt member and rollers that stretch the belt member. When the dispersed toner or paper powder is adhered to the rollers or the back surface of the belt member, for example, when they are adhered to a drive roller, the rotation speed of the belt member becomes unstable, which may lead to image degradation. Further, there is a fear that dispersed toner or paper powder that has been adhered to a plurality of rollers scratch the belt member to cause breaking of the belt.

In light of the above, Jpn. Pat. Appln. Laid-Open Publication No. 2001-192136 discloses an apparatus that includes a roller cleaning member for cleaning the back surface of a conveyor belt or intermediate transfer belt and the front surface of a drive roller for driving these belts.

In this conventional cleaning unit, a cleaning member such as a felt, adhesive rubber, acrylic brush, or fur brush is directly attached to a fixed supporting member. That is, the cleaning member is pressed to the drive roller by the fixed supporting member, increasing a load applied to the drive roller. Therefore, it is necessary to previously increase a torque for causing the drive roller to rotate the belt member in consideration of a load applied to the drive roller by the cleaning member. As a result, there occurs a need to increase a drive power of the drive roller for rotating the belt member as well as a need to increase the strength of the belt unit.

Thus, there is demanded development of a cleaning unit for a roller member supporting a belt capable of reducing a load applied to the roller member by the cleaning member for cleaning the roller that supports the belt member to thereby stabilize the rotation speed of the belt member as well as reducing a drive power for driving the roller member and an image forming apparatus mounting such a cleaning unit.

SUMMARY OF THE INVENTION

An aspect of the present invention is to provide a cleaning unit for a roller member supporting a belt capable of reducing a load applied to a roller member by the cleaning unit to stabilize the rotation speed of the belt member without increasing a drive torque of the roller member as well as achieving power saving and improving image quality.

According to an embodiment of the present invention, there is provided a cleaning unit for a roller member supporting a belt, comprising: a cleaning member which is brought into contact with at least one of roller members for stretching a belt member opposite to an image carrier carrying a toner image; and an elastic member which presses the cleaning member toward the roller member.

DETAILED DESCRIPTION OF THE INVENTION

Figure 1:
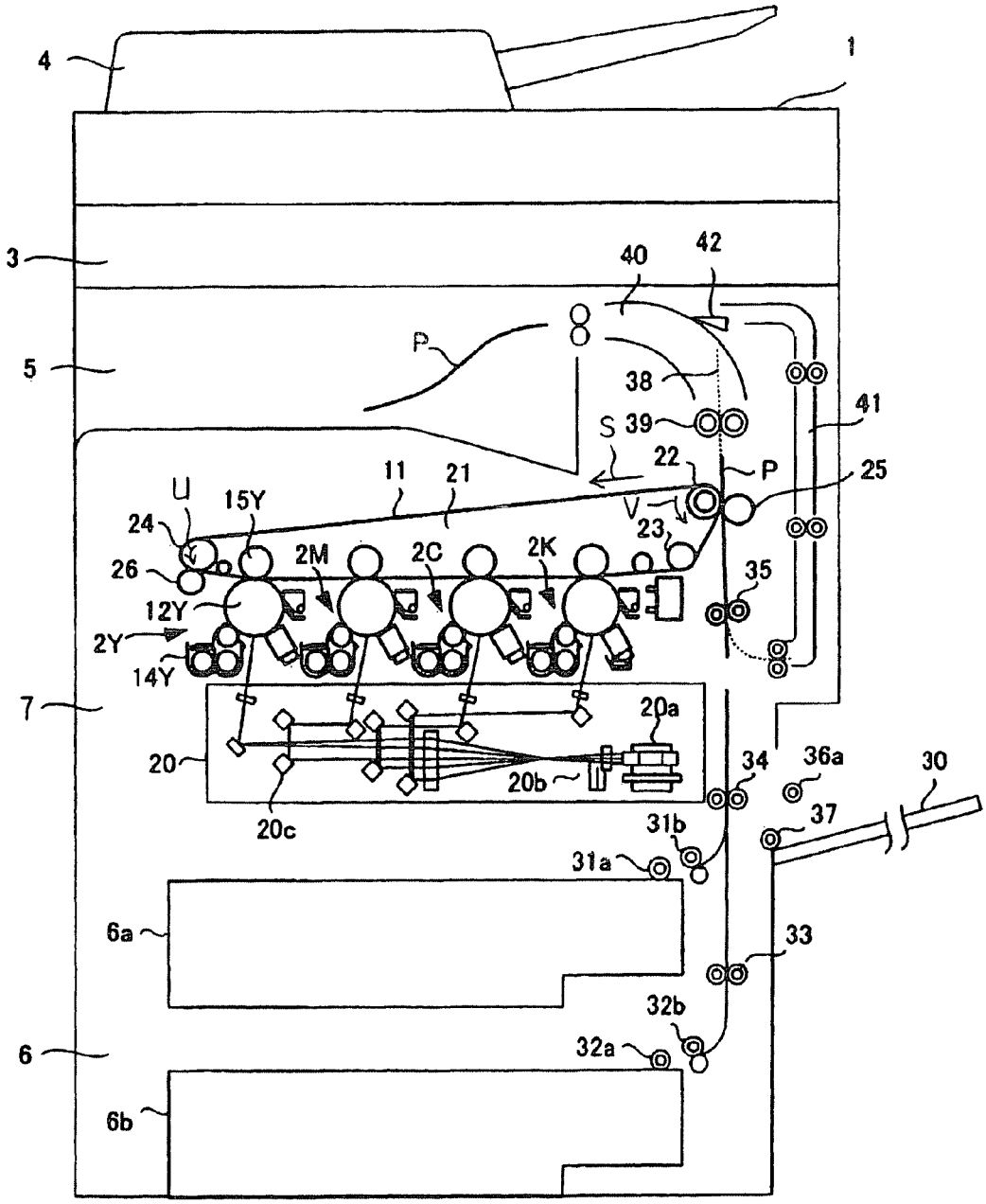
FIG. 1 is a view showing the entire configuration of an image forming apparatus according to a first embodiment of the present invention.
Figure 2:
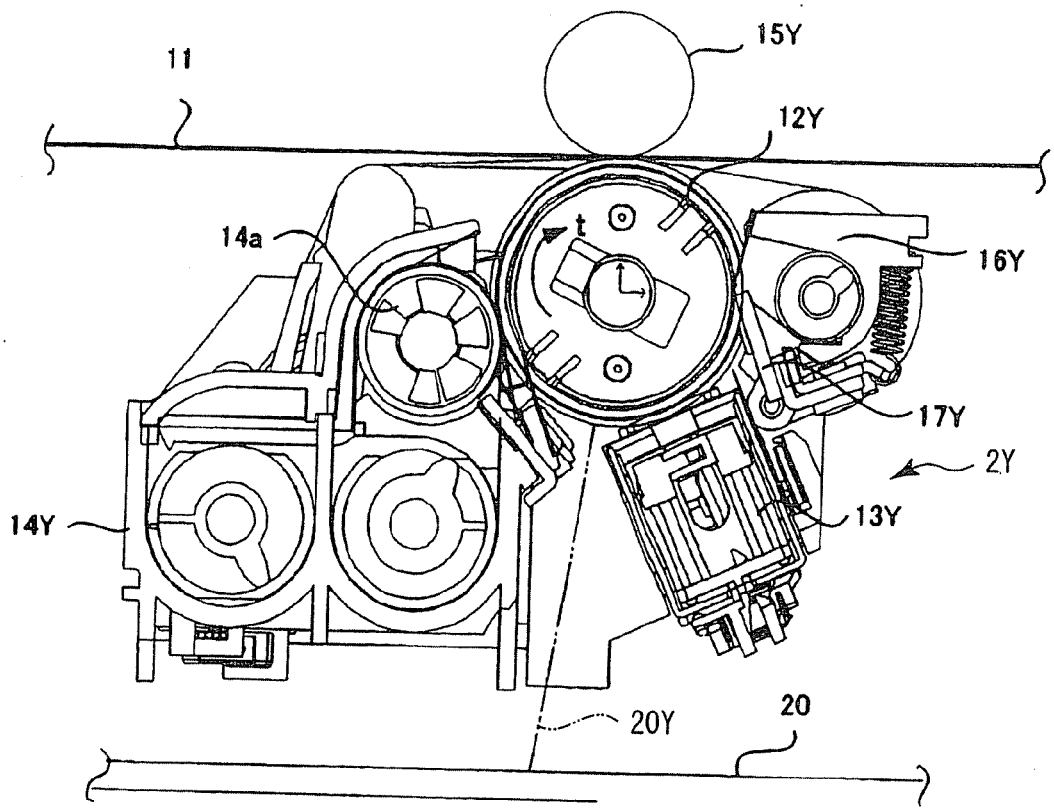
FIG. 2 is an explanatory view schematically showing an image forming unit according to the first embodiment of the present invention.

A first embodiment of the present invention will be described in detail below with reference to the accompanying drawings. FIG. 1 is a view schematically showing a configuration of an image forming apparatus 1 that includes an intermediate transfer belt 11 according to the first embodiment of the present invention. FIG. 2 is a partly-enlarged view of the image forming apparatus of FIG. 1. Although the following description will be made when the present invention is applied to a copier, the present invention is not limited only to such application, and it may be equally applied to other types of image forming apparatus such as an MFP (Multi-Function Peripheral) or printer. The image forming apparatus 1 has a printer section 7 at the center portion of its main body and an image read section 3, an ADF (Auto Document Feeder) 4, and an in-body sheet discharge section 5 at its upper portion. Further, a control panel (not shown) having a display panel is provided on the upper portion of the image forming apparatus 1, and a sheet supply section 6 is provided at the lower portion thereof. The ADF 4 feeds a document to the image read section 3, and the image read section 3 reads the document and stores read image data therein.

The printer section 7 is constituted by a color laser printer of a tandem system. The laser printer scans a photoconductor by a laser beam from a laser exposure unit 20 to generate an image. More specifically, the laser printer irradiates the photoconductor with the laser beam from the laser exposure unit 20 via an optical system and scans the surface thereof to expose the photoconductor to form an electrostatic latent image on the photoconductor and, after that, develops the electrostatic latent image to thereby form a toner image on the photoconductor drum. Further, the laser printer transfers the toner image on the photoconductor to a sheet via the intermediate transfer belt.

The printer section 7 has image forming units 2Y, 2M, 2C, and 2K of respective colors of yellow (Y), magenta (M), cyan (C), and black (K). The respective image forming units 2Y, 2M, 2C, and 2K are arranged in a line on the lower side of an intermediate transfer belt 11 which is a belt member in the order mentioned from upstream to downstream with respect to the rotation direction denoted by an arrow s. Hereinafter, description will be made with suffixes of Y, M, C, and K added to the reference numerals indicating components of the image forming units 2Y, 2M, 2C, and 2K, or description will be made collectively with the suffixes Y, M, C, and K omitted.

Description will be made hereinafter with reference to the image forming unit 2Y of yellow as a representative. As shown in FIG. 2, a charger 13Y, a development unit 14Y, a primary transfer roller 15Y, and a cleaner 16Y having a blade 17Y are arranged in series around the photoconductor drum 12Y which is rotated in the direction of an arrow t. An exposure position located between the charger 13Y and development unit 14Y is irradiated with a yellow laser beam 20Y from the laser exposure unit 20. Each of the other image forming units 2M (Magenta), 2C (Cyan), 2K (Black) have the same configuration as that of 2Y.

The charger 13 of each of the image forming units 2 uniformly charges the surface of the photoconductor drum 12 at, e.g., about −700 V. The development unit 14 uses a development roller 14*a* to which a development bias of about −500 V is applied to supply the photoconductor drum 12 with a two component developer formed by mixing carrier and toner of respective colors. The cleaner 16 uses the blade 17 to remove residual toner on the surface of the photoconductor drum 12.

The laser exposure unit 20, which is configured to scan the surface of the photoconductor drum 12 in the axial direction thereof with a laser beam emitted from a laser diode, has a polygon mirror 20*a*, an imaging lens system 20*b*, a mirror 20*c*, and the like.

Figure 3:
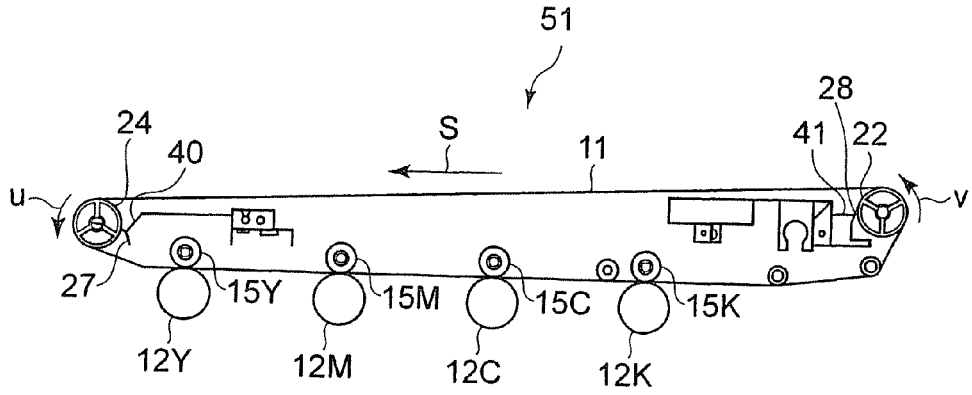
FIG. 3 is a view schematically showing a configuration of an intermediate transfer belt unit according to the first embodiment of the present invention.
Figure 4:
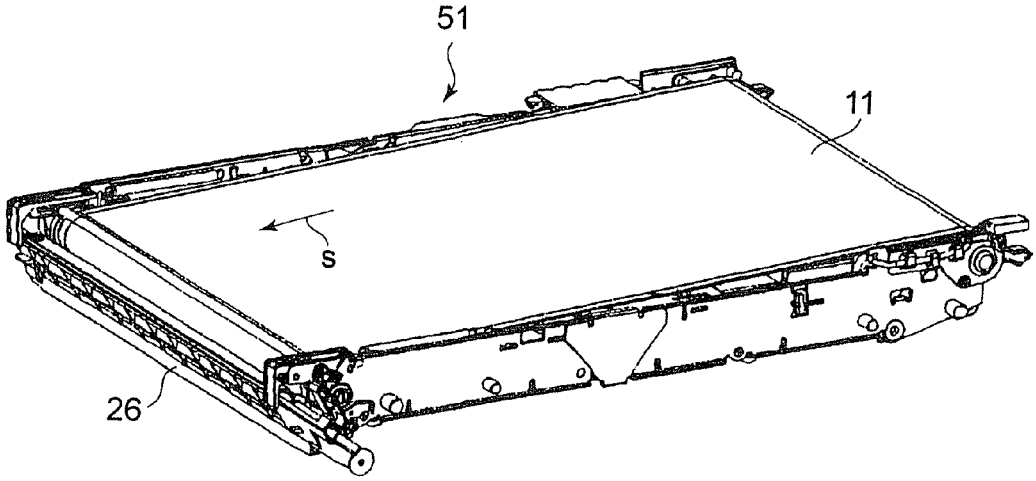
FIG. 4 is a perspective view showing the intermediate transfer belt unit according to the first embodiment of the present invention.

FIGS. 3 and 4 show an intermediate transfer belt unit 51. The intermediate transfer belt 11 of the intermediate transfer belt unit 51 is composed of a semiconductive polyimide which is a material having stable properties in terms of heat resistance and wear resistance and is rotated in the direction of an arrow s. The intermediate transfer belt 11 is stretched over a group of roller members including a drive roller 24, a secondary transfer supporting roller 22, and a tension roller 23. The intermediate transfer belt 11 is so provided as to be brought into contact with the photoconductor drums 12Y, 12M, 12C, and 12K in an opposed manner. The drive roller 24 for stretching the intermediate transfer belt 11 transfers a drive force from a main motor (not shown) to the intermediate transfer belt 11.

A secondary transfer roller 25 is disposed opposite to the secondary transfer supporting roller 22 for stretching the intermediate transfer belt 11. The secondary transfer roller 25 applies a secondary transfer voltage of about +1000 V when a sheet P passes through a secondary transfer position between the secondary transfer supporting roller 22 and secondary transfer roller 25. This voltage application allows a toner image on the intermediate transfer belt 11 to be secondary-transferred onto the sheet P. A belt cleaner 26 is provided near the drive roller 24 of the intermediate transfer belt 11. The belt cleaner 26 cleans the periphery of the intermediate transfer belt 11.

Figure 5:
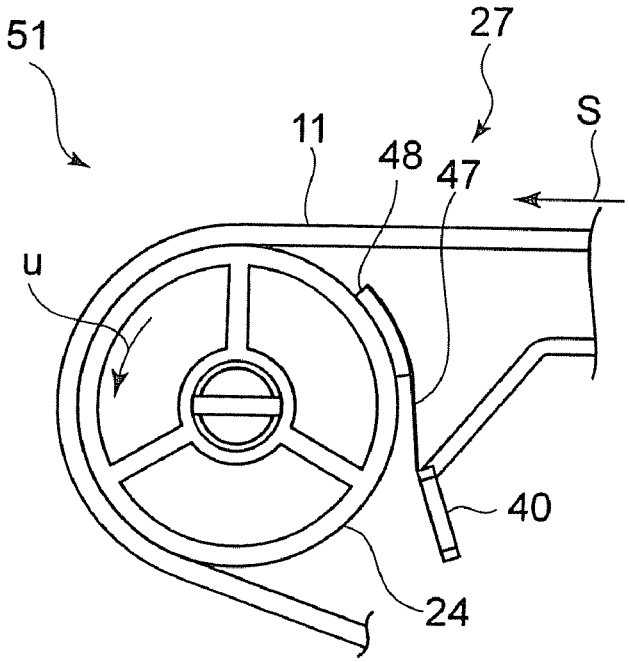
FIG. 5 is a view schematically showing a configuration of a first roller cleaner according to the first embodiment of the present invention.
Figure 6:
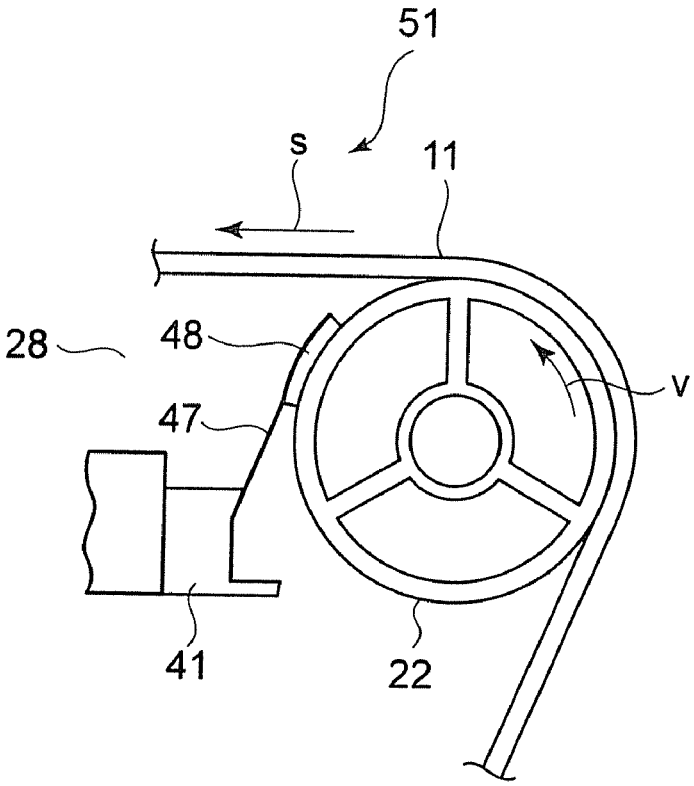
FIG. 6 is a view schematically showing a configuration of a second roller cleaner according to the first embodiment of the present invention.

As shown in FIG. 5, a first roller cleaner 27 is brought into contact with the drive roller 24. Further, as shown in FIG. 6, a second roller cleaner 28 is brought into contact with the secondary transfer supporting roller 22. The first roller cleaner 27 is constituted by a MYLAR (polyethylene terephthalate film) 47 which is an elastic member and a felt 48 which is a cleaning member attached to a free end of the MYLAR 47. The other end of the MYLAR 47 is fixed to a first bracket 40 made of a sheet metal.

In the first roller cleaner 27, the MYLAR 47 swingably supports the felt 48 by its elastic force and presses the felt 48 against the drive roller 24 with a moderate application of pressure. As a result, the felt 48 of the first roller cleaner 27 slidably contacts the drive roller 24 which is rotated in the direction of an arrow u to clean it. During rotation of the drive roller 24, the drive roller 24 is vibrated by the reception of the drive force and the like. However, the first roller cleaner 27 uses the MYLAR 47 to absorb the vibration generated in the drive roller 24. Therefore, there is no fear that the vibration generated in the drive roller 24 is transmitted to the first bracket 40 via the first roller cleaner 27.

The second roller cleaner 28 has the same configuration as that of the first roller cleaner 27. The second roller cleaner 28 is constituted by a MYLAR 47 and a felt 48 which is a cleaning member attached to a free end of the MYLAR 47. The other end of the MYLAR 47 is fixed to a second bracket 41 made of a mold.

In the second roller cleaner 28, the MYLAR 47 swingably supports the felt 48 by its elastic force and presses the felt 48 against the second transfer supporting roller 22 with a moderate application of pressure. As a result, the felt 48 of the second roller cleaner 28 slidably contacts the rotating second transfer supporting roller 22 to clean it. During rotation of the second transfer supporting roller 22, the second transfer supporting roller 22 is vibrated by feeding operation of the sheet P and the like. However, the second roller cleaner 28 uses the MYLAR 47 to absorb the vibration generated in the second transfer supporting roller 22. Therefore, there is no fear that the vibration generated in the second transfer supporting roller 22 is transmitted to the second bracket 41 via the second roller cleaner 28.

The sheet supply section 6 of the image forming apparatus 1 includes sheet supply cassettes 6*a* and 6*b* for storing sheets P of various sizes. The image forming apparatus 1 further includes a manual sheet feed tray 30 for manually supplying the sheet P. Pickup rollers 31*a*, 32*a* for picking up the sheet P from the sheet supply cassettes 6*a* and 6*b*, separation rollers 31*b*, 32*b*, feed rollers 33, 34, and a resist roller 35 are disposed between the sheet supply cassettes 6*a*, 6*b* and secondary transfer position between the secondary transfer supporting roller 22 and secondary transfer roller 25. Further, a pickup roller 36*a* for picking up the sheet P and a manual sheet supply roller 37 are disposed between the manual sheet feed tray 30 and resist roller 35.

A fixing unit 39 is disposed on the downstream side of the secondary transfer roller 25 along a vertical path 38 for vertically feeding the sheet P supplied from the sheet supply cassettes 6*a*, 6*b* or manual sheet feed tray 30. A sheet discharge path 40 is provided between the fixing unit 39 and in-body sheet discharge section 5. Further, a refeed path 41 for refeeding the sheet P to the resist roller 35 is provided on the downstream side of the fixing unit 39. Moreover, a gate 42 is provided on the downstream side of the fixing unit 39. At this point, the sheet P is directed to the sheet discharge path 40 side or refeed path 41 side.

Next, operation will be described. After an image forming process is started, image information is input from a scanner or a PC terminal to the image forming apparatus 1. As a result, in the respective image forming units 2Y, 2M, 2C, and 2K, photoconductor drums 12Y, 12M, 12C, and 12K are rotated to sequentially carry out the image forming process. Taking the image forming unit 2Y (Yellow) as an example, the photoconductor drum 12Y is rotated in the direction of an arrow t, and the surface thereof is uniformly charged by the charger 13Y.

Subsequently, the photoconductor drum 12Y is irradiated with the laser beam 20Y corresponding to image information of yellow (Y), with the result that an electrostatic latent image is formed on the photoconductor drum 12Y. The electrostatic latent image on the photoconductor drum 12Y is developed by the development unit 14Y, with the result that a toner image of yellow (Y) is formed on the photoconductor drum 12Y. After that, the photoconductor drum 12Y is brought into contact with the intermediate transfer belt 11 which is rotated in the direction of an arrow s, and the toner image of yellow (Y) on the photoconductor drum 12Y is transferred onto the intermediate transfer belt 11 by a transfer voltage which is applied by the primary transfer roller 15Y.

In the same manner as the toner image forming process of yellow (Y), the toner image forming processes of magenta (M), cyan (C), and black (K) are carried out in the respective image forming units 2M, 2C, and 2K. The toner images formed on the respective photoconductor drums 12M, 12C, and 12K are sequentially transferred onto the toner image formation position of yellow (Y) on the intermediate transfer belt 11 in a superimposed manner. As a result, a full-color toner image in which the respective toner images of yellow (Y), magenta (M), cyan (C), and black (K) are multiple-transferred is obtained on the intermediate transfer belt 11.

After that, the full-color toner image formed on the intermediate transfer belt 11 reaches the secondary transfer position and secondary-transferred onto the sheet P collectively by a transfer bias of the secondary transfer roller 25. In synchronization with the movement of the full-color toner image on the intermediate transfer belt 11 toward the secondary transfer roller 25, the sheet P is fed to the secondary transfer position from the sheet supply cassettes 6*a*, 6*b* or manual sheet feed tray 30. The sheet P onto which the full-color toner image has been transferred is subjected to an image fixing process by the fixing roller 39 and, thereby, the toner image is completed. After the image has been fixed, the sheet P is discharged by the gate 42 to the in-body sheet discharge section 5 side if one-sided printing is chosen. On the other hand, if double-sided printing or multiple printing is chosen, the sheet P is directed to the refeed path 41 side by the gate 42 and is then re-fed to the secondary transfer roller 25 side.

Meanwhile, the felt 48 of the first roller cleaner 27 is pressed against the drive roller 24 which is rotated in the direction of an arrow u by an elastic force of the MYLAR 47, so that the toner, paper powder, or dust adhered to the surface of the drive roller 24 is cleaned by the felt 48. Likewise, the felt 48 of the second roller cleaner 28 is pressed against the secondary transfer supporting roller 22 which is rotated in the direction of an arrow v by an elastic force of the MYLAR 47, so that the toner, paper powder, or dust adhered to the surface of the secondary transfer supporting roller 22 is cleaned by the felt 48. The first roller cleaner 27 or second roller cleaner 28 makes the drive roller 24 or secondary transfer supporting roller 22 slidably come in contact with the felt 48 via the MYLAR 47 having an elastic force. Therefore, there is no fear that the drive roller 24 or secondary transfer supporting roller 22 receives an excessive load from the felt 48.

After completion of the secondary transfer, residual toner on the surface of the intermediate transfer belt 11 is cleaned by the belt cleaner 26. Further, after the toner image on the photoconductor drum 12 has been primary-transferred onto the intermediate transfer belt 11, residual toner on the photoconductor drum 12 is removed by the blade 17. This allows the photoconductor drum 12 to perform a subsequent image forming process.

According to the present embodiment, the drive roller 24 or secondary transfer supporting roller 22 is slidably contacted with the felt 48 of the first roller cleaner 27 or second roller cleaner 28 while being rotated during the image forming process and thereby the surface thereof is cleaned, which makes it possible for the drive roller 24 to drive the intermediate transfer belt 11 at a stable rotation speed, or which makes it possible to prevent the secondary transfer supporting roller 22 from disturbing bias. As a result, it is possible to obtain a satisfactory transfer image with good transfer characteristics in both the primary transfer of the toner image from the photoconductor drum 12 to the intermediate transfer belt 11 and the secondary transfer of the toner image from the intermediate transfer belt 11 to the sheet P. Further, the felt 48 is pressed against the drive roller 24 or secondary transfer supporting roller 22 by an elastic force of the MYLAR 47.

This configuration prevents the felt 48 from applying an excessive load to the drive roller 24 or secondary transfer supporting roller 22, thus reducing a load applied to the drive roller 24 or secondary transfer supporting roller 22. As a result, a drive torque for driving the drive roller 24 can be reduced to thereby achieve power saving.

Next, a second embodiment of the present invention will be described with reference to FIGS. 7 and 8. The present embodiment uses a conveyer belt in place of the intermediate transfer belt employed in the first embodiment to clean roller members that stretch this conveyor belt. In the second embodiment, a toner image formed on the photoconductor drum is directly transferred onto a sheet on the conveyer belt. In this embodiment, the same reference numerals as the first embodiment are given to the components which are common to the first embodiment, and the detailed description thereof is omitted.

Figure 7:
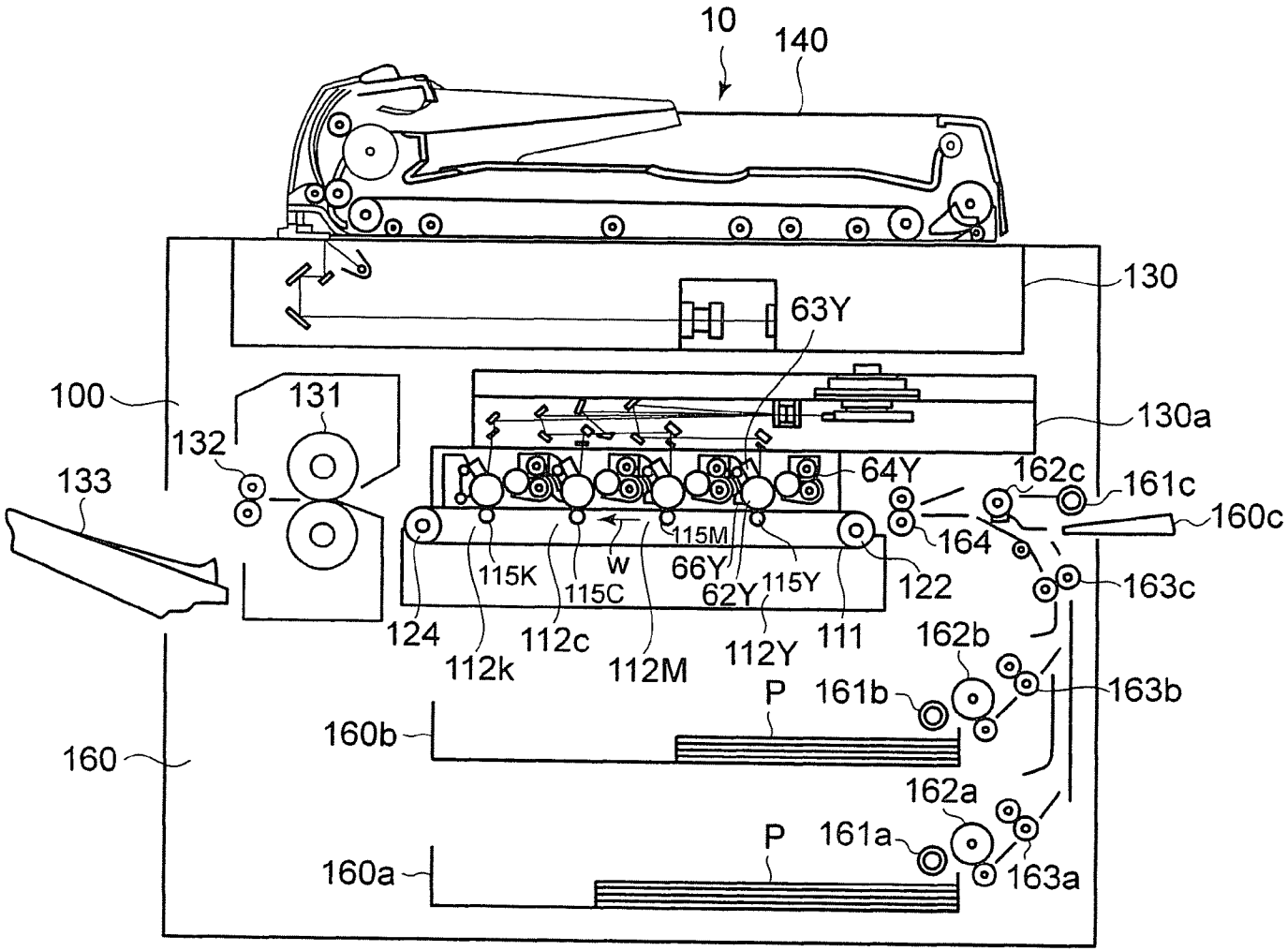
FIG. 7 is a view showing the entire configuration of an image forming apparatus according to a second embodiment of the present invention.

An image forming apparatus 10 according to the present embodiment shown in FIG. 7 includes a printer section 100, an image read section 130, an ADF 140, and a sheet supply section 160. The printer section 100 has image forming units 112Y, 112M, 112C, 112K of respective colors of yellow (Y), magenta (M), cyan (C), and black (K). The respective image forming units 112Y, 112M, 112C, and 112K are arranged in a line on the upper side of a conveyor belt 111 which is a belt member in the order mentioned from upstream to downstream with respect to the rotation direction denoted by an arrow w.

The image forming units 112Y, 112M, 112C, and 112K each have the same function as those of the image forming units 2Y, 2M, 2C, and 2K, although there is a slight difference between them. For example, a charger 63Y, a development unit 64Y, a transfer roller 115Y, and a cleaner 66Y are arranged in series along the rotation direction of the photoconductor drum 62Y around the photoconductor drum 62Y of the image forming unit 112Y of yellow (Y). An exposure position located between the charger 63Y and development unit 64Y is irradiated with a yellow laser beam from the laser exposure unit 130*a*. Each of the other image forming units 112M (Magenta), 112C (Cyan), and 112K (Black) have the same configuration as that of 112Y.

The sheet supply section 160 includes sheet supply cassette units 160*a*, 160*b* and a manual sheet feed tray 160*c*. The sheet supply cassette units 160*a* and 160*b* are detachably attached to the sheet supply section 160. The manual sheet feed tray 160*c* is used for manually supplying the sheet P and is provided at the right side of the image forming apparatus 10. First to third pickup rollers 161*a* to 161*c* for picking up the sheet P from the sheet supply cassette units 160*a* and 160*b* or manual sheet feed tray 160*c*, first to third separation rollers 162*a* to 162*c*, first to third conveyor rollers 163*a* to 163*c*, and a resist roller 164 are disposed on the upstream side of the conveyor belt 111. A fixing roller 131, a sheet discharge roller 132, and a sheet discharge tray 133 are disposed on the downstream side of the conveyor belt 111.

Figure 8:
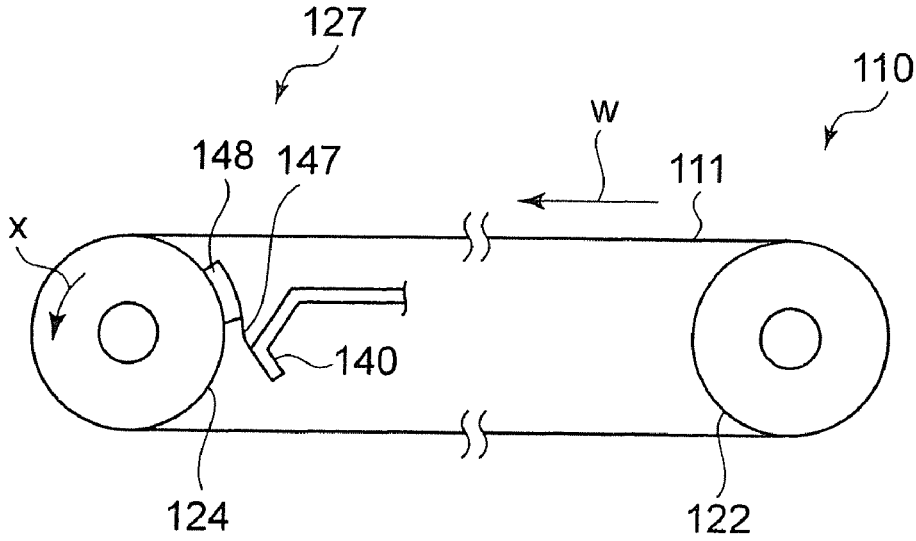
FIG. 8 is a view schematically showing a configuration of a conveyor belt unit according to the second embodiment of the present invention.

The conveyor belt 111 of the conveyor belt unit 110 shown in FIG. 8 is formed of a conductive polyurethane rubber and is stretched over a group of roller members including a drive roller 124 and a driven roller 122. Transfer rollers 115Y, 115M, 115C, and 115K are disposed at the positions opposed respectively to the photoconductor drums of the image forming units 112Y, 112M, 112C, and 112K arranged along the conveyor belt 111.

As shown in FIG. 8, a roller cleaner 127 is brought into contact with the drive roller 124. The roller cleaner 127 includes a MYLAR 147 and a felt 148 which is a cleaning member attached to a free end of the MYLAR 147. The other end of the MYLAR 47 is fixed to a third bracket 140 made of a sheet metal.

The roller cleaner 127 utilizes an elastic force of the MYLAR 147 to swingably support the felt 148 and press the felt 148 to the drive roller 124 with a moderate application of pressure. As a result, the felt 148 of the roller cleaner 127 slidably contacts the rotating drive roller 124 to clean it. At this time, the drive roller 124 is vibrated by the reception of the drive force and the like. However, when the vibration of the drive roller 124 reaches the MYLAR 147 via the felt 148, it is absorbed by the MYLAR 147. Therefore, there is no fear that the vibration generated in the drive roller 124 is transmitted to the third bracket 140 via the roller cleaner 127.

Next, operation will be described. After an image forming process is started, image information is input from a scanner or a PC terminal to the image forming apparatus 10. As a result, in the respective image forming units 112Y, 112M, 112C, and 112K, photoconductor drums are rotated to sequentially carry out the image forming process. Toner images that have been formed on the photoconductor drums of the respective image forming units 112Y, 112M, 112C, and 112K in the same manner as the first embodiment are sequentially transferred onto the sheet P fed by the conveyor belt 111 which is rotated in the direction of an arrow w of FIG. 8 in a superimposed manner. As a result, a full-color toner image in which the respective toner images of yellow (Y), magenta (M), cyan (C), and black (K) are multiple-transferred is obtained on the sheet P.

The sheet P onto which the full-color toner image has been transferred is subjected to an image fixing process by the fixing roller 131 and, thereby, the toner image is completed. After the image has been fixed, the sheet P is passed through the sheet discharge roller 132 and is discharged to the sheet discharge tray 133. Meanwhile, the felt 148 of the roller cleaner 127 is pressed against the drive roller 124 which is rotated in the direction of an arrow x by an elastic force of the MYLAR 147, so that the toner, paper powder, or dust adhered to the surface of the drive roller 124 is cleaned by the felt 148. At this time, the elastic force of the MYLAR 147 prevents an excessive load from being applied to the drive roller 124 from the felt 148. After completion of the toner image transfer, residual toner on the surface of the photoconductor drum is cleaned by the cleaner. This allows the photoconductor drum to perform a subsequent image forming process.

According to the present embodiment, the surface of the drive roller 124 is cleaned by the felt 148 while the image forming process is performed, which makes it possible for the drive roller 124 to drive the conveyor belt 111 at a stable rotation speed. As a result, it is possible to obtain a satisfactory transfer image with good transfer characteristics. Further, the felt 148 is pressed against the drive roller 124 by an elastic force of the MYLAR 47, which prevents the felt 148 from applying an excessive load to the drive roller 124, thus reducing a load applied to the drive roller 124. As a result, a drive torque for driving the drive roller 124 can be reduced to thereby achieve power saving.

The present invention is not limited to the above-mentioned embodiments and various modifications can be made within the scope of the present invention. For example, the cleaning member is not limited to the felt but may be a fur brush or an adhesive rubber. Further, the elastic member may be a plate-like rubber or a plate spring. Moreover, the image forming apparatus may be any type of image forming apparatus such as a monochrome image forming apparatus as long as it has a belt member.

Figure 9:
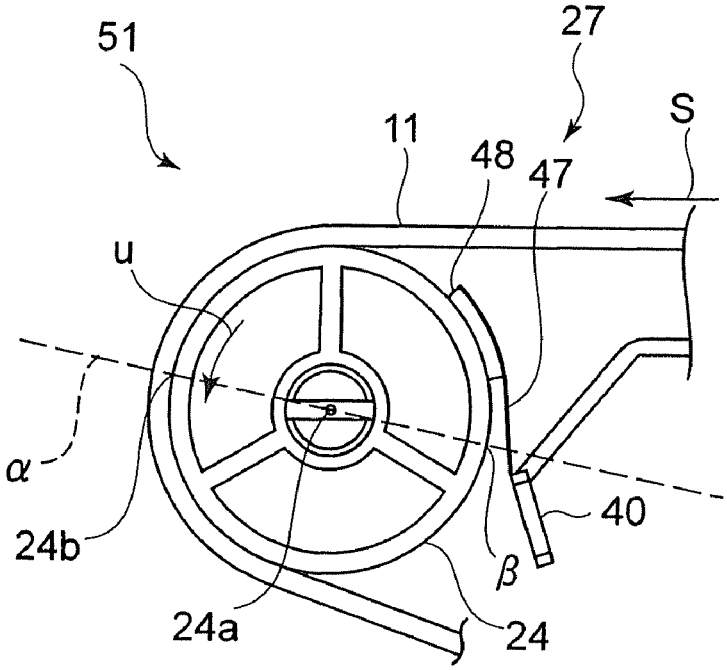
FIG. 9 is a view schematically showing a configuration of a roller cleaner according to a first modification of the present invention.

Further, the contact position of the cleaning member relative to the roller member is not limited. However, the contact position of the cleaning member relative to the roller member may be set as shown in a first modification of FIG. 9. More specifically, in the configuration of the first modification of FIG. 9, a point at which an extended line of a dotted line $\alpha$, which connects the center 24*b* of the area in which the intermediate transfer belt 11 and drive roller 24 contact each other and a center 24*a* of the drive roller 24, crosses the outer circumference of the drive roller 24 is set to $\beta$, and the felt 48 of the first roller cleaner 27 of the first embodiment is brought into contact with the drive roller 24 at the downstream area relative to the intersecting point $\beta$ between the dotted line $\alpha$ and outer circumference of the drive roller 24 with respect to the rotation direction denoted by an arrow u of the drive roller 24. Then, the drive roller 24 is cleaned.

When the felt 48 contacts the drive roller 24 at the downstream area of the rotation of the drive roller 24 as described above, dispersed toner or dust adhered to the drive roller 24 during rotation thereof can be cleaned immediately before the drive roller 24 contacts the intermediate transfer belt 11 in the subsequent rotation. Therefore, it is possible to reduce the opportunity that dispersed toner adheres to the drive roller 24 between the time period after the completion of the cleaning of the drive roller 24 by the felt 48 and subsequent contact between the drive roller 24 and the intermediate transfer belt 11 to prevent the dispersed toner or the like from being introduced between the intermediate transfer belt 11 and the drive roller 24, thereby preventing occurrence of rotation irregularity or vibration more certainly.

Figure 10:
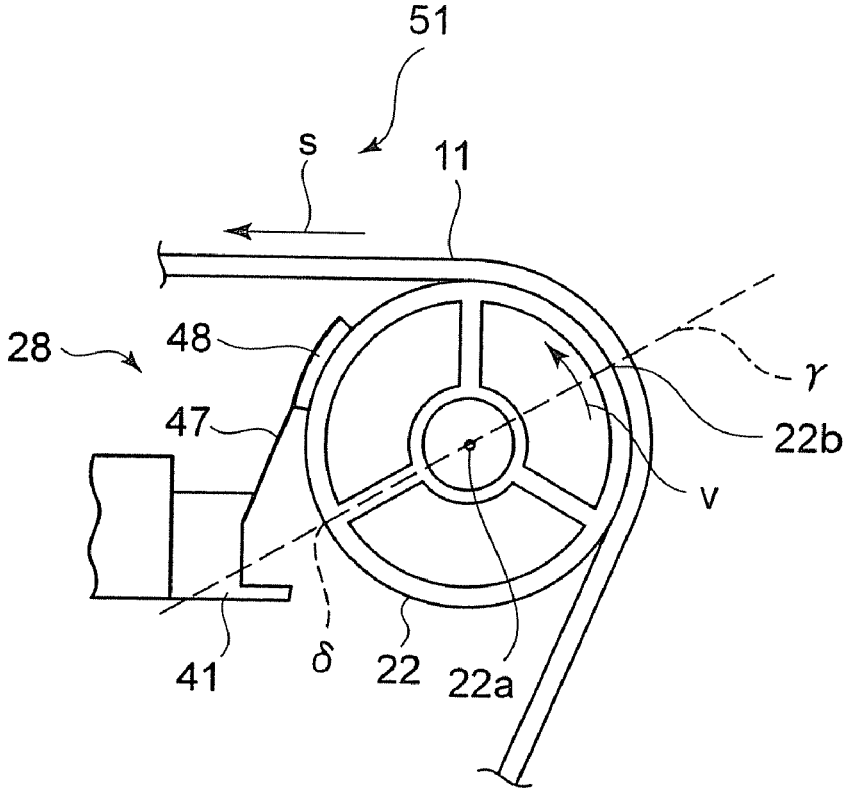
FIG. 10 is a view schematically showing a configuration of a roller cleaner according to a second modification of the present invention.

Further, the contact position of the cleaning member relative to the roller member may be set as shown in a second modification of FIG. 10. More specifically, in the configuration of the second modification of FIG. 10, a point at which an extended line of a dotted line γ, which connects the center 22*b* of the area in which the intermediate transfer belt 11 and secondary transfer supporting roller 22 contact each other and a center 22*a* of the secondary transfer supporting roller 22, crosses the outer circumference of the secondary transfer supporting roller 22 is set to δ, and the felt 48 of the second roller cleaner 28 of the first embodiment is brought into contact with the secondary transfer supporting roller 22 at the upstream area relative to the intersecting point δ between the dotted line γ and outer circumference of the secondary transfer supporting roller 22 with respect to the rotation direction denoted by an arrow v of the secondary transfer supporting roller 22. Then, the secondary transfer supporting roller is cleaned.

When the felt 48 contacts the secondary transfer supporting roller 22 at the upstream area of the rotation of the secondary transfer supporting roller 22 as described above, dispersed toner or dust that has been generated at the time of the secondary transfer and adhered to the secondary transfer supporting roller 22 can immediately be cleaned. That is, it is possible to prevent the dispersed toner or the like adhered to the secondary transfer supporting roller 22 from being dispersed once again, thus improving cleaning performance.

Further, the positional relationship between the felt 48 and MYLAR 47 in the first embodiment is not limited. However, it is possible to control a load applied from the felt 48 to the roller member depending on whether the MYLAR 47 is disposed on the upstream side or downstream side relative to the felt 48 with respect to the rotation direction of the roller member. If the MYLAR 47 is disposed on the upstream side relative to the felt 48 with respect to the rotation direction of the roller member, the felt 48 is supported by the MYLAR 47 in such a direction that the felt 48 is moved away from the roller member. On the other hand, if the MYLAR Mylar 47 is disposed on the downstream side relative to the felt 48 with respect to the rotation direction of the roller member, the felt 48 is supported by the MYLAR 47 in such a direction that the felt 48 is moved toward the roller member.

For example, in the first roller cleaner 27 that cleans the drive roller 24 according to the abovementioned first embodiment, the MYLAR 47 is disposed on the upstream side relative to the felt 48 with respect to the rotation direction (denoted by an arrow u) of the drive roller 24. When the first roller cleaner 27 is disposed as above, the felt 48 is supported by the MYLAR 47 in the moving-away direction with respect to rotation of the drive roller 24.

Therefore, it is possible to reduce a load applied from the felt 48 to the drive roller 24. It is desirable that the drive roller 24 side that needs to favorably drive the intermediate transfer belt 11 without causing rotation irregularity or vibration receive a smaller load from the felt 48. When the MYLAR 47 is disposed on the upstream area relative to felt 48 with respect to the rotation direction of the drive roller 24 as in the case of the above-mentioned first embodiment, it is possible to reduce a load applied from the felt 48 to the drive roller 24 at the time of cleaning. As a result, influence that the first roller cleaner 27 exerts on the drive of the intermediate transfer belt 11 can be reduced.

Figure 11:
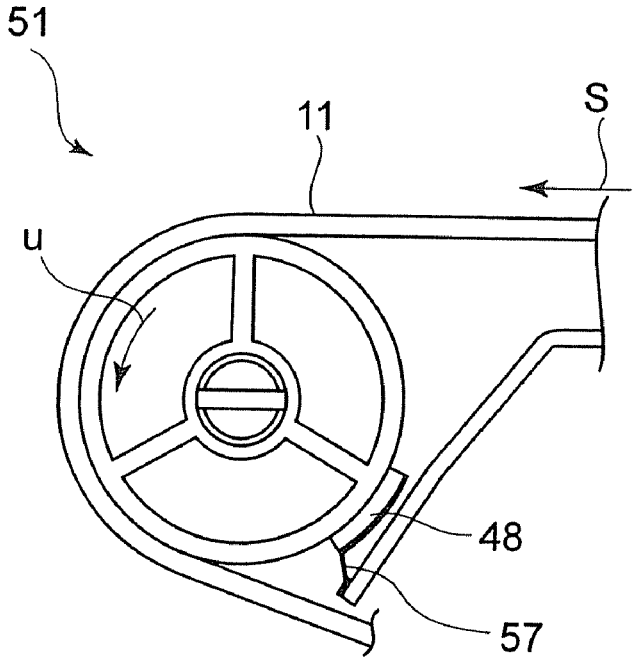
FIG. 11 is a view schematically showing a configuration of a roller cleaner according to a third modification of the present invention.

The position of the roller cleaner for supporting the felt 48 in the moving-away direction with respect to rotation of the drive roller 24 is not limited. For example, a configuration as shown in a third modification of FIG. 11 may be adopted. Also in this case, as long as a MYLAR 57 is disposed on the upstream side relative to the felt 48 with respect to the rotation direction (denoted by an arrow u) of the drive roller 24, it is possible to allow the felt 48 to be brought into contact with the drive roller 24 on the upstream area with respect to the rotation direction of the drive roller 24 for cleaning or the like.

Further, for example, in the second roller cleaner 28 that cleans the secondary transfer supporting roller 22 according to the abovementioned first embodiment, the MYLAR 47 is disposed on the downstream side relative to the felt 48 with respect to the rotation direction (denoted by an arrow v) of the secondary transfer supporting roller 22. When the second roller cleaner 28 is disposed as above, the felt 48 is supported by the MYLAR 47 in the moving-toward direction with respect to rotation of the secondary transfer supporting roller 22.

As a result, it is possible to allow the felt 48 to apply a predetermined load to the secondary transfer supporting roller 22. In the abovementioned first embodiment, the MYLAR 47 is disposed on the downstream area relative to the felt 48 with respect to the rotation direction of the secondary transfer supporting roller 22 on the secondary transfer supporting roller 22 side that is not likely to adversely affect the drive of the intermediate transfer belt 11. This configuration allows the felt 48 to apply a small but sufficient amount of load to the secondary transfer supporting roller 22, thereby improving cleaning performance of the secondary transfer supporting roller 22.

Figure 12:
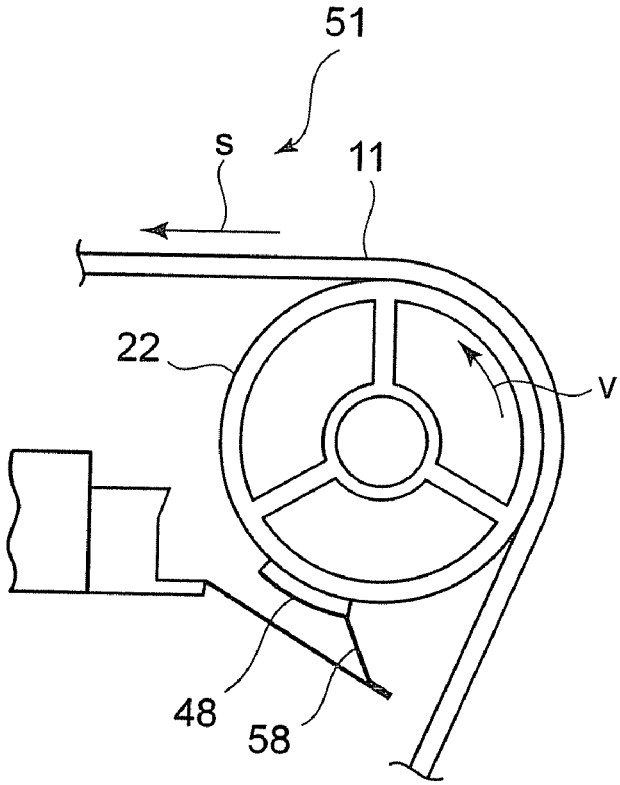
FIG. 12 is a view schematically showing a configuration of a roller cleaner according to a fourth modification of the present invention.

The position of the roller cleaner for supporting the felt 48 in the moving-toward direction with respect to rotation of the secondary transfer supporting roller 22 is not limited. For example, a configuration as shown in a fourth modification of FIG. 12 may be adopted. Also in this case, as long as a MYLAR 58 is disposed on the downstream side relative to the felt with respect to the rotation direction (denoted by an arrow v) of the secondary transfer supporting roller 22, it is possible to allow the felt 48 to be brought into contact with the secondary transfer supporting roller 22 on the downstream area with respect to the rotation direction of the secondary transfer supporting roller 22 for cleaning or the like.

Figure 13:
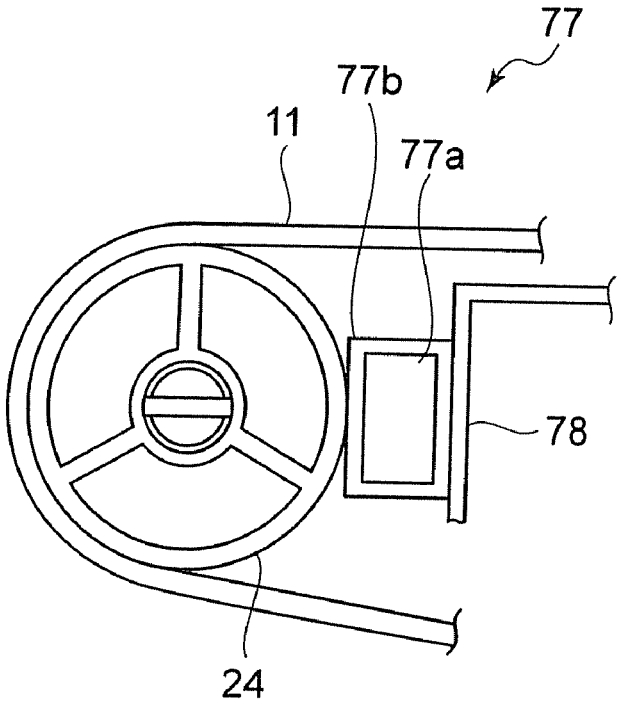
FIG. 13 is a view schematically showing a configuration of a roller cleaner according to a fifth modification of the present invention.

Further, the configuration of the cleaning member or elastic member is not limited. For example, as shown in a fifth modification of FIG. 13, a roller cleaner 77 constituted by a MYLAR 77*a* (elastic member) having a rectangular cross-section and a felt 77*b* surrounding the MYLAR 77*a* may be employed. More specifically, as shown in FIG. 13, one side of the roller cleaner 77 incorporating the MYLAR 77*a* as a core material of the felt 77*b* is fixed to a bracket 78, and the other side thereof opposite to the one side where the felt 77*b* is fixed is pressed against, e.g., the drive roller 24 of the first embodiment. According to this modification, the felt 77*b* cleans the drive roller 24, which makes it possible to drive the intermediate transfer belt 11 at a stable rotation speed. Further, it is possible to prevent the felt 77*b* from being excessively pressed against the drive roller 24 by an elastic force of the MYLAR 77*a*, thereby reducing a load applied to the drive roller 24. As a result, a drive torque for driving the drive roller 24 can be reduced to thereby achieve power saving.

What is claimed is:

1. An image forming apparatus comprising:

an image carrier which carries a toner image;

a belt member opposite to the image carrier;

roller members which include at least one drive roller that transfers a drive force to the belt member and stretch the belt member;

a cleaning member which is brought into contact with at least one of the roller members; and an elastic member which is positioned on the upstream side relative to the cleaning member with respect to the rotation direction of the drive roller and presses the cleaning member toward the drive roller.

2. An image forming apparatus comprising:

an image carrier which carries a toner image;

a belt member opposite to the image carrier;

roller members which include at least a drive roller for transferring a drive force to the belt member and a tension roller for giving a tension to the belt member and stretch the belt member, a plurality of cleaning members which are provided to bring into contact with at least the drive roller and the tension roller, respectively, the cleaning member contacting the drive roller is positioned at the downstream area relative to an intersecting point between a line connecting the center of the area in which the belt member and drive roller contact each other and a center of the drive roller and outer circumference of the drive roller with respect to the rotation direction of the drive roller, and the cleaning member contacting the tension roller is positioned at the upstream area relative to an intersecting point between a line connecting the center of the area in which the belt member and tension roller contact each other and a center of the tension roller and outer circumference of the tension roller with respect to the rotation direction of the tension roller; and a plurality of elastic members which are provided to press the cleaning members toward the drive roller and tension roller, respectively.

3. An image forming apparatus comprising:

an image carrier which carries a toner image;

a belt member opposite to the image carrier;

roller members which include at least a drive roller for transferring a drive force to the belt member and a tension roller for giving a tension to the belt member and stretch the belt member;

a plurality of cleaning members which are provided to bring into contact with at least the drive roller and the tension roller, respectively; and a plurality of elastic members which are positioned on the upstream side relative to the cleaning member with respect to the rotation direction of the drive roller, respectively, and the plurality of elastic members are provided to press the cleaning members toward the drive roller and the tension roller, respectively.

4. An image forming apparatus comprising:

an image carrier which carries a toner image;

an intermediate transfer belt which is opposite to the image carrier and holds and feeds the toner image primary-transferred from the image carrier and secondary-transfers it to a transfer medium;

roller members which include at least a drive roller for transferring a drive force to the intermediate transfer belt and a secondary transfer supporting roller for supporting the intermediate transfer belt at a position at which the toner image is secondary-transferred onto the transfer medium and stretch the intermediate transfer belt;

a plurality of cleaning members which are provided to bring into contact with at least the drive roller and the secondary transfer supporting roller, respectively, the cleaning member contacting the drive roller is positioned at the downstream area relative to an intersecting point between a line connecting the center of the area in which the intermediate transfer belt and drive roller contact each other and a center of the drive roller and outer circumference of the drive roller with respect to the rotation direction of the drive roller, and the cleaning member contacting the secondary transfer supporting roller is positioned at the upstream area relative to an intersecting point between a line connecting the center of the area in which the intermediate transfer belt and secondary transfer supporting roller contact each other and a center of the secondary transfer supporting roller and outer circumference of the secondary transfer supporting roller with respect to the rotation direction of the secondary transfer supporting roller; and a plurality of elastic members which are provided to press the cleaning members toward the drive roller and the secondary transfer supporting roller, respectively.

5. An image forming apparatus comprising:

an image carrier which carries a toner image;

an intermediate transfer belt which is opposite to the image carrier and holds and feeds the toner image primary-transferred from the image carrier and secondary-transfers it to a transfer medium;

roller members which include at least a drive roller for transferring a drive force to the intermediate transfer belt and a secondary transfer supporting roller for supporting the intermediate transfer belt at a position at which the toner image is secondary-transferred onto the transfer medium and stretch the intermediate transfer belt;

a plurality of cleaning members which are provided to bring into contact with at least the drive roller and the secondary transfer supporting roller, respectively; and a plurality of elastic members which are provided for the drive roller is positioned on the upstream side relative to the cleaning member with respect to the rotation direction of the drive roller, the elastic member provided for the secondary transfer supporting roller is positioned on the downstream side relative to the cleaning member with respect to the rotation direction of the secondary transfer supporting roller, respectively, and the plurality of elastic members are provided to press the cleaning members toward the drive roller and the secondary transfer supporting roller, respectively.

* * * * *